United States Patent [19]

Martinek et al.

[11] Patent Number: 4,775,239

[45] Date of Patent: Oct. 4, 1988

[54] DOUBLE SHAFT FORCED-FEED MIXER FOR CONTINUOUS AND DISCONTINUOUS MANNER OF OPERATION

[75] Inventors: Rudolf Martinek, Legau; Johannes Oertel, Sonthofen, both of Fed. Rep. of Germany

[73] Assignee: BHS-Bayerische Berg-, Hütten- und Salzwerke AG, Fed. Rep. of Germany

[21] Appl. No.: 125,733

[22] Filed: Nov. 30, 1987

Related U.S. Application Data

[63] Continuation of Ser. No. 937,090, Dec. 2, 1986, abandoned.

[30] Foreign Application Priority Data

Dec. 11, 1985 [DE] Fed. Rep. of Germany ..... 3543745

[51] Int. Cl.[4] ..... B28C 5/08

[52] U.S. Cl. ..... 366/2; 366/40; 366/42; 366/66; 366/77; 366/168; 366/192; 366/300; 366/301

[58] Field of Search ..... 366/15, 66, 14, 77, 366/83-86, 96-99, 42, 64, 189, 192, 193, 33, 194, 40, 297, 36, 300, 301, 168, 173, 6, 42, 2

[56] References Cited

U.S. PATENT DOCUMENTS 2,861,787 11/1958 Csanyi .

FOREIGN PATENT DOCUMENTS 458100 1/1975 Australia .
0029394 2/1884 Fed. Rep. of Germany .
182350 3/1907 Fed. Rep. of Germany .
0344691 12/1919 Fed. Rep. of Germany .
0469230 4/1926 Fed. Rep. of Germany .
1112968 8/1958 Fed. Rep. of Germany .
1928537 12/1965 Fed. Rep. of Germany .
2141908 3/1973 Fed. Rep. of Germany .
2223792 3/1973 Fed. Rep. of Germany .
2166430 1/1974 Fed. Rep. of Germany .
2343237 3/1974 Fed. Rep. of Germany .
7631682 2/1977 Fed. Rep. of Germany .
3012707 10/1981 Fed. Rep. of Germany .
769106 2/1957 United Kingdom .
1154636 6/1969 United Kingdom .
1385126 2/1975 United Kingdom .

OTHER PUBLICATIONS

Pamphlet entitled "BHS-Doppelwellen-Zwangmischer für die Kalksandsteinindustrie", date unknown.
Pamphlet entitled "BHS-Mischanlangen", P-3/3-83.
Pamphlet entitled "BHS-Einwellen-Chargenmischer, date unknown.
Pamphlet entitled "BHS-Aufbereitungstechnik", P-3/-3-83.
Pamphlet entitled "Centrale a Beton BHS, Compacte, pour Chantier Important", date unknown.
Pamphlet entitled "BHS-Durchlaufmischer", P-2/-3-83.
Pamphlet entitled "BHS-Doppelwellen-Zwangsmischer", h-3/11-84.
Book entitled "Strassebaumaschinen", by A. I. Anochin, published Verlag Technik, Berlin 1952, S. 382/383, Picture 235.
Pamphlet entitled "Maschinen und Anlagen zum Zerkleinern, Klassieren, Fördern, Waschen, Entwässern und Mischen von Kies, Sand, Splitt, Schotter und Beton", P-10/2-85.
Publication by R. Martinek, Sonthofen, "Doppelwellen-Trogmischer in Chargen-und Konttinuierlicher Bauweise", date unknown.

*Primary Examiner*—Timothy F. Simone
*Attorney, Agent, or Firm*—Toren, McGeady & Associates

[57] ABSTRACT

A double-shaft forced-feed mixer, for example for building material mixtures, is proposed which is assembled according to the principle of movement of the batch-type mixer and is usable both for continuous and discontinuous operation.

26 Claims, 3 Drawing Sheets

DOUBLE SHAFT FORCED-FEED MIXER FOR CONTINUOUS AND DISCONTINUOUS MANNER OF OPERATION

This is a continuation of application Ser. No. 937,090, filed Dec. 2, 1986, abandoned.

BACKGROUND OF THE INVENTION

The invention relates to a double-shaft forced-feed mixer for mixing materials in powder, grain and plastic form, for example for the production of building material mixtures or the like, comprising a mixing trough and in this mixing trough two mutually parallel, oppositely driven mixing shafts extending between mutually opposite end walls of the mixing trough and fitted with spirally arranged mixing tools especially following a helical line, with substantially horizontally directed rotation axes, the directions of rotation of the mixing shafts being selected so that the mixing tools run upwards between the mixing shafts, while the mixing tools of the individual mixing shafts are formed and arranged in such a way that they effect contrary directions of delivery along the individual mixing shafts, the mixer further comprising charging means for the introduction of granular and if necessary liquid mixture components into the mixing trough and a closable bottom emptying opening, especially as rotary slider closure, extending over a large part of the trough length and arranged in the mixing trough bottom between the two mixing shafts.

In mixing techniques hitherto two different mixers have been necessary for the two manners of operation of continuous mixing and mixing by batches, which mixers have separately their fixed fields of application. For greater throughputs—but with limited mixing quality—the continuously operating double-shaft throughflow mixer is used, for smaller throughputs but with high mixing quality the discontinuously working double-shaft batch mixer has been used.

While in their assembly the two mixing systems are similar, they differ distinctly in their manners of operation.

STATEMENT OF THE PRIOR ART

In the double-shaft throughflow mixer the mixing process is completed continuously in the longitudinal direction of the mixing trough on the path between inlet opening and outlet opening. The two mixing shafts are here driven in opposite directions so that their mixing tools move upwards between the two shafts. The orientation of the mixing tools on the two shafts is such that on both shafts the mixing tools deliver in the same direction towards the outlet opening. It is a prerequisite for good and uniform homogeneity of the mixed material that all the mixture components are fed to the mixer in a continuous faultlessly quantity-regulated manner. A quantity regulation which is defective in time cannot be corrected subsequently by the double-shaft throughflow mixer, because the mixing process is completed between the two mutually parallel arranged mixing mechanisms only in an operative cross-section advancing in the transport direction (see Prospectus "BHS Throughflow Mixer" P-2/3-83, Page 2, "Mixing Mechanism" and special printing of an article by Dipl.-Ing. (FH) R. Martinek, Sonthofen, "Double-Shaft Trough Mixer of batch-type and continuous construction", last page).

From Fed. German Ut. Mod. No. 76 31 682 a double-shaft forced-feed mixer for the preparation of feedstuffs is known which works continuously, the mixing of solid and liquid feedstuffs being intended. The two parallel mixing shafts rotate oppositely so that the mixing tools move downwards between the mixing shafts. The two mixing shafts deliver with opposite delivery directions. A discharge with regulable cross-section is provided in the bottom of the mixing trough close to the one end wall between the two mixing shafts. An inlet opening is provided in the region of the other end wall above the mixing shaft delivering towards this other end wall. Operation by batches is not possible with this appliance since operation by batches requires a short time of emptying, which is not possible through the bottom emptying opening intended for continuous operation.

From Fed. German P.S. No. 29,394 a mixing machine for powdered materials is known in which the mixing shafts likewise deliver with their mixing tools in opposite directions and the charging and withdrawal are continuous. In this known mixing machine the directions of rotation of the mixing shafts are so selected that the mixing tools run upwards between the mixing shafts.

In the double-shaft batch mixer the mixing process is completed with a circulating mixture movement, but with a simultaneous exchange of mixture between the two mixing mechanisms.

For this purpose again the two shafts are driven oppositely. The orientation of the mixing tools on the two shafts is such that the mixing tools of the one shaft deliver in a first direction and the mixing tools of the second shaft in the opposite direction, so that as a result a circulating movement of the mixture is brought about. This manner of operation generates an especially intensive mixing of all mixture components. A working cycle is composed of: charging, mixing and emptying. The mixing process takes place with the bottom emptying opening closed and the mixing duration can be selected. The addition of the mixture components as a rule takes place by batches and emptying takes place within a short emptying duration through a bottom emptying opening of correspondingly large dimensions which extends in the bottom of the mixing trough between the two shafts approximately over the entire length of the mixing trough (see for example Prospectus "BHS Double-shaft Forced-feed mixer" h-3/11-84, pages 2 and 3 and the special print of the article by Martinek (see above), page 1).

From Fed. German Inspection Doc. No. 21 41 908 a double-shaft forced-feed mixer for batch operation is known in which a bottom emptying opening extending over a large part of its length with rotary slider closure is provided in the mixing trough bottom.

It is known from Fed. German P.S. No. 344,691 to equip such a batch mixer with a bottom opening with double flap closure.

It is known from G.B. P.S. No. 1,154,636 to provide an inlet hopper between the two mixer shafts in a batch-type mixer.

It is known from the book "Road Building Machines" by Prof. Dr. A. I. Anochin, Verlag Technik Berlin 1952, pages 382, 383, to arrange individual mixing tools in an asphalt concrete mixing machine in such a way that their spiral arrangement causes them to follow a helical line. It is known from Fed. German Inst. Doc. No. 22 23 792 to provide a filling level regulation system in a mixing mechanism.

OBJECT OF THE INVENTION

The invention is based upon the problem, starting from a double-shaft forced-feed mixer of the initially designated kind, as known for example from the Prospectus "BHS Double-Shaft Forced-Feed Mixers" h-3/11-84, to indicate a construction which can be used equally for batch operation and continuous operation.

SUMMARY OF THE INVENTION

To solve this problem it is proposed that the charging means, at least of the granular mixture components, are formed for the discontinuous or continuous feed of the granular mixture components and that in the region of one of the end walls a discharge opening arrangement is arranged at an axial distance from the entry of the charging means of the granular mixture components into the mixing trough and is so dimensioned or adjustable that when the bottom emptying opening is closed it continuously branches off a quantity of mixed material corresponding to the continuous charging of the mixture components from the mixture batch moving within the mixing trough.

It has appeared that a double-shaft forced-feed mixer formed in accordance with the invention can be designed with relatively slight conversion measures so that it is suitable equally for batch operation and continuous operation, so that at the utilisation site it is possible to transfer from the one manner of operation to the other according to quality and quantity requirements.

The axial distance between the point of entry of the charging means of the granular material and the discharge opening arrangement can here be favourably adjusted in that the entry of the charging means of the granular mixture components into the mixing trough lies in the region of that mixing shaft which delivers away from the end wall adjacent to the discharge opening arrangement. In this way a lengthened path of the continuously conveyed mixing material is achieved. Optimum mixing conditions for the continuous operation in the sense of the suppression of movement of unmixed granular mixture components to the discharge opening arrangement can be achieved if the entry of the charging means of the granular mixture components lies at a distance from the end wall remote from the discharge opening arrangement which amounts to about 30 to 70% of the clear internal length of the mixing trough in the mixing shaft direction.

In order that the necessary size may be imparted to the discharge opening arrangement—without influencing the mixture quality—it is advisable to make the discharge opening arrangement larger in the direction transverse to the mixing shafts than in the direction of the mixing shafts. In this case the discharge opening arrangement can extend approximately between the lowest points in each case of the mixing trough bottom shaped in double-trough manner, whereby the object is achieved that even liquid residues are reliably removed.

For liquid charging it is proposed that the charging means for liquid mixture components are arranged approximately along the entire batch circulation path within the mixing trough, and that for the continuous operation the liquid outflow from the charging means can be limited to a part of the circumference of the batch circulation path along one end wall and along the mixing shafts, especially to the part circumference from the location of the entry of the charging means of the granular mixture components to a point before the discharge opening arrangement. In this manner the object is achieved that the double-shaft forced-feed mixer can be adapted to the manner of operation even as regards the liquid requirement, by a simple conversion operation. For batch operation it proves advantageous to distribute the liquid supply over the entire batch circulation path. On the other hand for continuous operation the proposed limitation of the liquid feed to a part of the batch circulation path is advantageous, because thus the escape of unmixed liquid can be prevented.

The conversion from batch operation to continuous operation becomes especially simple if the charging means for the liquid mixture components consist of two separately supplied U-tubes with liquid discharge positions distributed over their length, which tubes are arranged above the mixing shafts, a first U-tube intended for continuous operation extending—seen in plan view—approximately along the mixing shaft axes and along the end wall remote from the discharge opening arrangement, and a second U-tube supplementing the first U-tube to form an approximately closed loop.

In order that mixing times may be shortened in this continuous operation it is proposed that the charging means for the granular mixture components comprise a separate charging point, especially an inlet hopper, for batch charging, namely between the two mixing shafts and preferably in the middle of the length of the mixing trough between the two end walls.

In order to achieve a circulating movement of the batch of mixed material moving in the mixing trough in each case without blockages, it is advisable that the two mixing mechanisms should each be equipped with a reversing device at that end where the movement of the mixture batch effected by them strikes upon an end wall, which device deflects the mixed material along the end wall in each case to the other mixing mechanism. This is a measure which proves advantageous for both types of operation, especially in the case of materials which are difficult to mix.

In order that the circulating movement of the batch of material in the mixing trough may be influenced, it is possible to arrange a baffle element in the path of circulation of the batch before the discharge opening arrangement, namely rigidly or adjustably, possibly by pivoting or withdrawal. This baffle element can be provided with apertures in any desired number, shape and size. This baffle element is especially advantageous for the continuous manner of operation so that the outflow may be regulated.

The discharge opening arrangement can be formed with a single or double flat slider closure, but also with a single or double hinged flap closure or with a segment closure.

As an alternative to a rotary slider closure for the bottom emptying opening a single or double hinged flap closure may come under consideration, with regard to the great length.

In order that, especially in the case of continuous operation, the feed of mixture components and the withdrawal of mixed material may be regulated so that a constant batch remains stationary in the mixing trough, a filling level regulation system is advisable. This filling level regulation system can measure the batch size or filling level by means of a batch size signalling device, especially a filling level indicator, and correct departures from an ideal value by modification of the mixture component charging and/or of the mixture outlet.

BRIEF DESCRIPTION OF THE DRAWINGS

The invention is explained by reference to an example of embodiment by the accompanying Figures, wherein.

DESCRIPTION OF THE PREFERRED EMBODIMENTS

Figure 1:
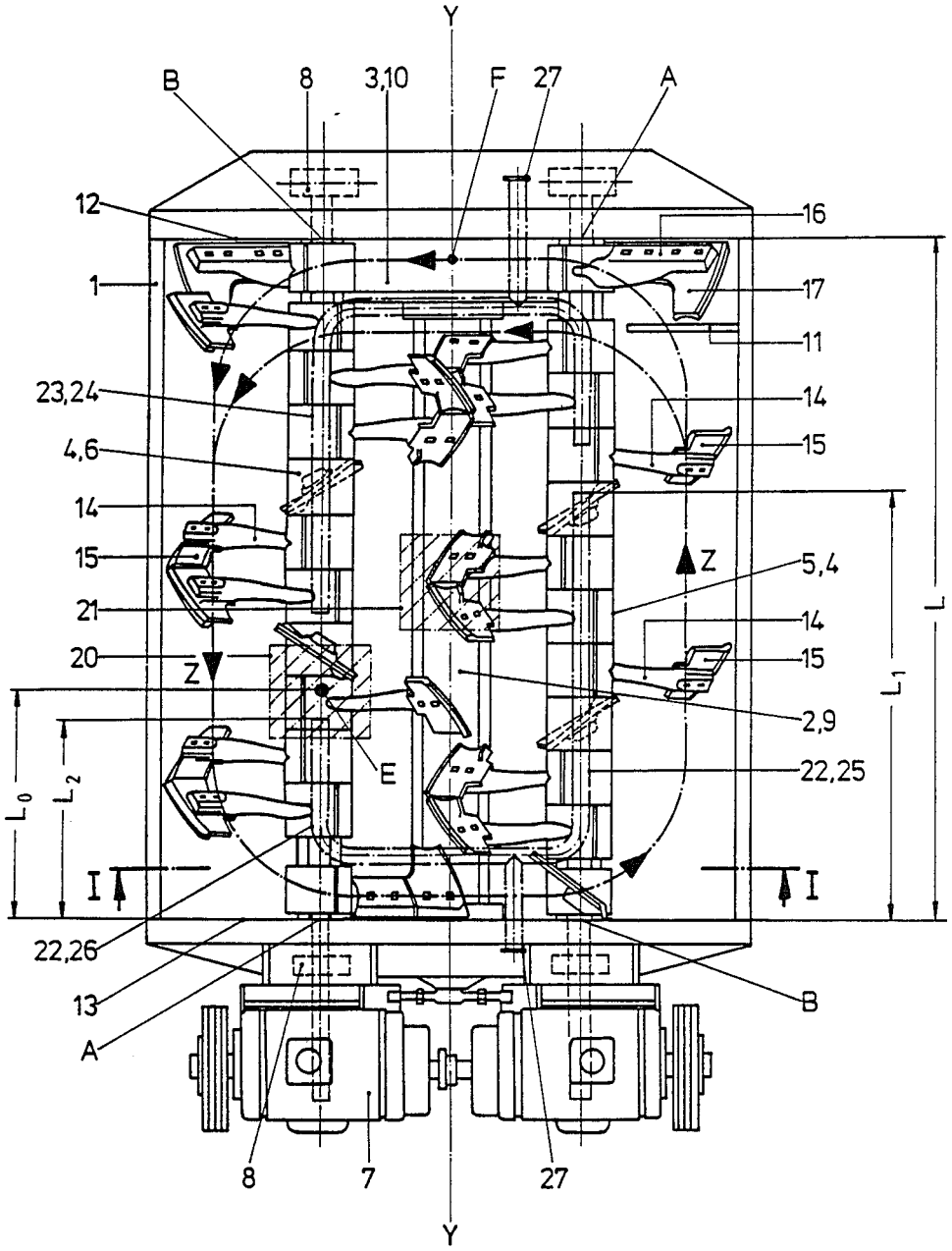
FIG. 1 shows a diagrammatic plan view of the double-shaft forced-feed mixer according to the invention.
Figure 2:
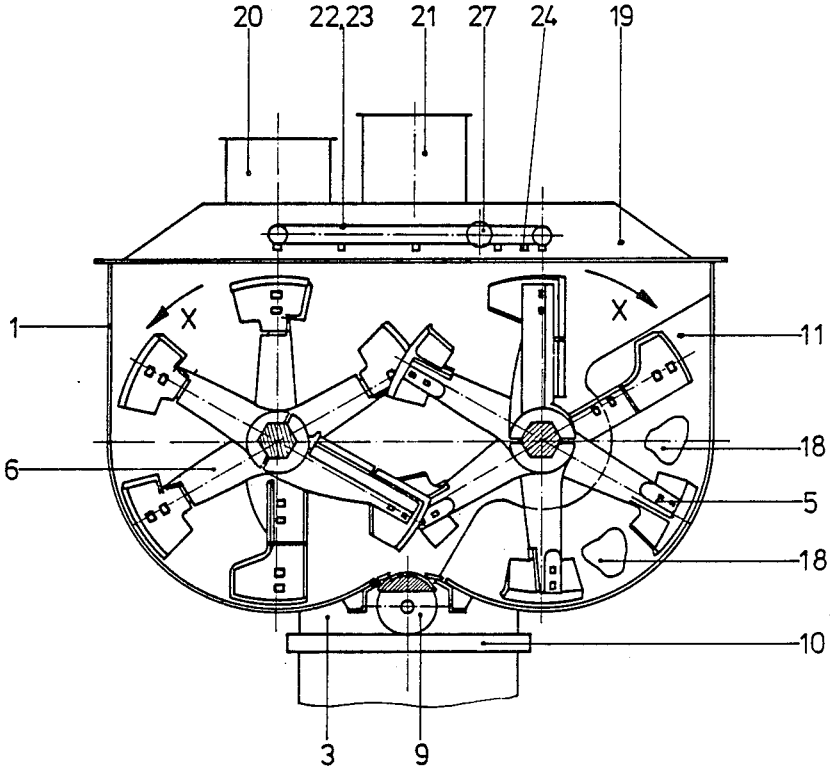
FIG. 2 shows a section along the line I—I in FIG. 1
Figure 3:
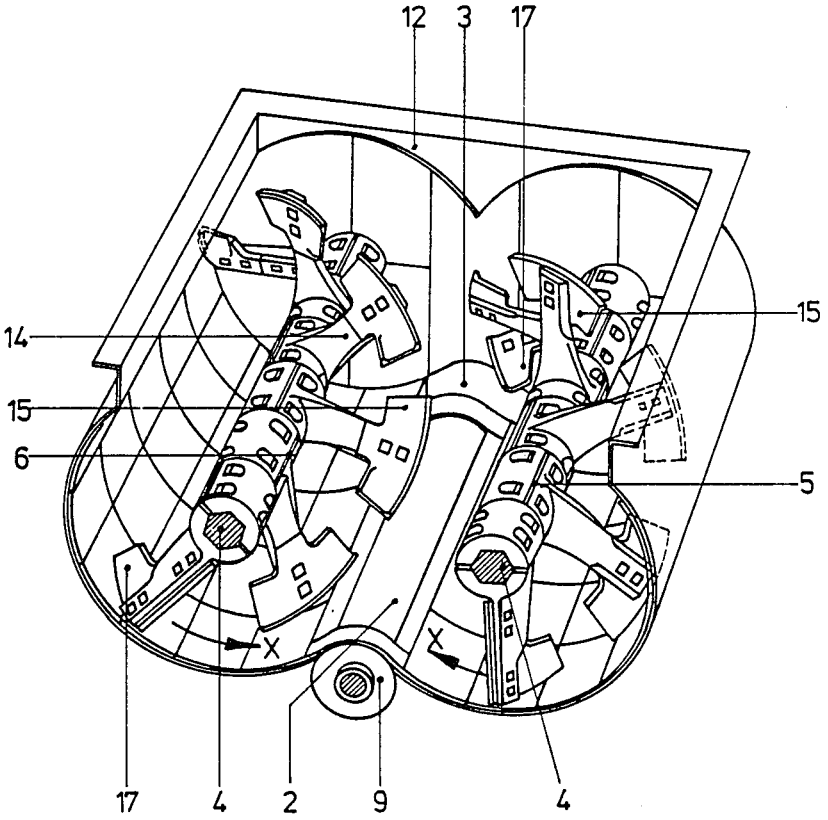
FIG. 3 shows a perspective partial view of the double-shaft forced-feed mixer.

The double-shaft forced-feed mixer for continuous and/or discontinuous operation consists essentially of a mixing trough 1 with at least one elongated, rectangular bottom emptying opening 2 arranged at the bottom in the longitudinal direction y—y, which opening can be opened or closed by means of an emptying closure 9 and extends over the major part of the length of the bottom. A discharge opening arrangement 3 is arranged in a position transverse to the longitudinal direction y—y in a compact rectangular form at the bottom of the mixing trough, in the vicinity of the trough end wall 12, and can likewise be opened or closed by means of an emptying closure 10. The two emptying closures 9 and 10 together occupy approximately the whole length of the bottom.

Furthermore two mixing mechanisms 5 and 6 arranged parallel with one another and in the longitudinal direction y—y are provided, the horizontal shafts 4 of which are mounted in bearings 8 on both sides outside the trough end walls 12 and 13 and driven in synchronism in opposite rotation directions x for example through a unilaterally arranged mixer drive 7. The two mixing mechanisms 5 and 6 are vane-type mixing mechanisms which consist of a transport and mixing apparatus, that is of several mixing arms 14 arranged one behind another with mixing vanes 15 and a reversing apparatus, that is of at least one clearing arm 16 with a reversing tool, namely a clearing vane 17, and are secured each on a mixing shaft 4, the mixing vanes 15 being arranged with spiral arrangement in the same direction but rising to the left, the clearing vanes 17 being arranged oppositely, that is rising to the right. Due to the many mixing vanes 15 arranged one behind another on the two mixing mechanisms 5 and 6 with rise in the same direction an opposite transport movement is caused which finally generates a mixture movement circulating in the mixing trough in the counter-clockwise direction z with simultaneous exchange of mixed material between the mixing mechanisms 5 and 6. The oppositely directed transport movement of the two mixing mechanisms effects a build-up zone A and a suction zone B at the respective trough end walls 12 and 13. For this reason each mixing mechanism is equipped in the region of the build-up zone A in the vicinity of the trough end walls 12 and 13 with at least one clearing arm 16 which carries an oppositely risingly arranged clearing vane 17 which transports the built-up mixed material from the build-up zone A to the suction zone B and in doing so imparts to the mixed material a deflection movement component away from the pertinent end wall 12, 13 in each case.

Due to this operation the circulating mixture movement z is also substantially supported and kept in flow.

In the mixing trough 1, on the side of the vane-type mixing mechanism 3 between the clearing vane 17 and the last mixing vane 15 in the vicinity of the build-up zone A a so-called baffle plate 11 can be arranged rigidly or adjustably, outwardly pivotably or withdrawably, which according to need can also be provided with apertures 18 in any desired number, shape and size. With this baffle plate in the case of continuous operation the circulating mixture movement z can be additionally braked according to need with the aim of increasing the time of sojourn or passage of the mixture in the mixing trough.

Above the mixing trough 1 a cover hood 19 is arranged in which there are arranged at least two inlet hoppers 20 and 21 for the feed of the granular mixture components and two U-shaped pipes 22 and 23 for the feed of the liquid mixture components. The inlet hopper 20 is fitted above the longitudinal axis of the mixture mechanism 6 at a defined charging point. Thus it is guaranteed that in the case of a continuous manner of operation the mixing operation takes place between the vane-type mixing mechanisms 5 and 6 on a long transport path, beginning at the charging point E and ending at the emptying point F. A second inlet hopper 21 can be arranged in the middle region of the mixing trough between the vane-type mixing mechanisms 5 and 6 in order that according to choice, in the case of a discontinuous manner of operation and materials difficult to mix, the granular mixture components can also be added centrally to the trough with the aim of reducing the mixing time and increasing the mixer throughput.

Any desired positions E, adapted to different materials for mixing, are possible for the inlet hopper 20. The length ration $L_o/L$—related to the charging point E—can vary in limits from 0.3 to 0.7. $L_o$ is the distance from the centre point E to the mixing trough end wall 13; L is the internal length of the mixing trough 1 between the end walls 12 and 13.

The U-shaped conduits 22 and 23 are provided with holes or nozzles 24 and with pipe connections 27 laid anywhere to the exterior, through which the supply of the liquid mixture components takes place. The legs of the two U-shaped conduits are of different lengths.

For the U-shaped conduit the length of the conduit leg 25—over the mixing mechanism 5—extends at maximum to a distance $L_1=0.85\times L$, the length of the pipe leg 26, above the mixing mechanism 6, up to a maximum distance of $L_2=0.5\times L$, both lengths measured from the end wall 13. In general it is valid that the charging means 22 for the liquid mixture components extend as far as a position $L_1$ which is distant from the end wall 13 remote from the discharge opening arrangement 3 by approximately 50 to 85%, preferably about 75%, of the clear internal mixing trough length L. The U-shaped conduit 22 is in use in discontinuous operation.

It is to be noted that on reversal of the vane spiral from left to right the circulatory movement z also reverses, which necessarily changes the charging position E, the U-shaped conduits and the pressure and suction zones A and B in mirror image.

With the double-shaft forced-feed mixer it is possible to produce any desired mixtures, as for example including concrete and mortar or even mineral mixtures for hydraulically bound carrier layers for road building, in continuous or discontinuous manner of operation, due to the advantage of the circulating mixture movement in the direction z with simultaneous mixture exchange between the two mixing mechanisms 5 and 6, with high mixture quality.

In the continuous operation of the mixer it is however a prerequisite that all granular mixture components are added in continuously quantity-regulated manner by way of the inlet hopper 20 and all liquid mixture components are added in continuously quantity-regulated manner by way of the U-shaped conduit 22. During the mixing process in this case the bottom emptying opening 2 is closed, but the discharge opening arrangement 3 is opened.

At the beginning of each continuous mixing process the two openings 2 and 3 remain closed during the filling of the mixing trough 1. After the filling quantity corresponding to one batch is reached however the filling operation is interrupted and the introduced mixture is made ready within an adjustable pre-mixing time. Thereupon the continuous operation is initiated by a regulated, continuous emptying of the mixture. with simultaneous continuation, adapted thereto, of continuous mixer charging. This measure in the continuous mixing process guarantees a uniform homogeneous mixture from beginning to end without the disadvantageous homogeneity fluctuations during the filling phase, such as pertain to the known continuous mixing methods. The time for shutting off the material flow after the filling phase can be controlled by means of a time relay, a filling level probe or the loading of the drive motor.

The end of each continuous mixing process begins with the emptying phase or shutting off of the mixer charging. The emptying phase is completed with the discharge opening arrangement 3 opened and lasts until the mixing trough is cleared. By additional opening of the bottom discharge opening 2 it is possible to accelerate the complete emptying of the mixing trough.

In the case of discontinuous operation of the mixer all granular and liquid mixture components are added by regulated batches, and the granular components can be added likewise through the inlet hopper 20 or equally through the second inlet hopper 21. The liquid mixture components are however to be added in regulated manner at the same time through the separate conduits 22 and 23. In the case of the discontinuous operation the baffle plate 11 can be partially or wholly pivoted out or withdrawn according to need.

The mixing process takes place with mixing duration selectable as desired and always with the openings 2 and 3 closed. For the emptying of the mixing trough the bottom emptying opening 2 is to be used for preference, but it is also possible to empty simultaneously through both openings 2 and 3 in order to accelerate the emptying operation.

The closure 9 for the bottom emptying opening 2 can be formed as a rotary slider closure or as a single or double hinged flap closure, and any desired open positions are settable.

On the other hand the closure 10 for the discharge opening arrangement 3 can be made as a single or double hinged flap closure, as a segment closure or as a single or double flat slider closure, and in the case of the double flat slider closure both flat sliders can be arranged offset in height in relation to one another.

The double-shaft batch mixer can be used falling or rising in the longitudinal direction as well as the preferred horizontal position of installation.

By way of summary the continuous operation can be described as follows:

Firstly a starting batch of granular mixed components is introduced through the hopers 20 and/or 21. The corresponding quantity of liquid mixture components is added through the U-pipes 22 and/or 23. In this case the two openings 2 and 3 are closed. After filling, firstly mixing is effected without withdrawal, the mixing occurring primarily in the region between the two shafts 4, where the ascending mixing vanes effect a turbulence which promotes the mixing action. As soon as the mixture batch has reached the desired homogenisation the starting phase is terminated. Now granular mixture components are added continuously through the inlet hopper 20, possibly being pre-mixed or in parallel currents. At the same time the discharge opening arrangement 3 is opened, namely so far that per unit of time a mixture quantity is drawn off which corresponds to the mixture components added per unit of time. At the same time liquid mixture components are added continuously through the U-pipe 22. The granular mixture components can include finely powdered constituents up to coarse-grained constituents. The mutual adaptation of the supply and mixture components through the hopper 20 and the withdrawal of mixture through the discharge opening arrangement 3 is effected by a regulating system (not shown) which ensures that the mixture batch stationarily present in the mixing trough remains constant. If for a time there is no need for mixture, the supply of mixture components and the withdrawal of mixture can be temporarily halted, without the mixing mechanisms 5 and 6 being shut off.

The position of the inlet hopper 20 at the location 4 ensures that in continuous operation a relatively long distance is available to the mixture components added through the inlet hopper 20 before the discharge opening arrangement 3 is reached.

The inlet hopper 20 should not be brought into the immediate vicinity of the end wall 12, since in this case the transverse delivery effect of the mixer vanes 15 could lead to unmixed mixture components arriving in the region of the mixing mechanism 5 and being transported by its mixing vanes on too short a residual distance to the discharge opening arrangement 3.

If the installation is to be halted, then after the shutting off of the supply of the mixture components it can be gradually emptied through the discharge opening arrangement 3 or emptied very much more quickly through the additional opening of the bottom emptying opening 2 as well.

In discontinuous operation, with the openings 2 and 3 closed the mixture components are supplied for preference through the filling hopper 21, which can be of such large dimensions that it can be charged for example by means of a grab. Fundamentally however even for discontinuous operation charging through the inlet hopper 20 is possible. Mixing takes place with the openings 2 and 3 closed, until the desired homogenisation is achieved. Then the withdrawal of the entire batch takes place through the bottom emptying opening 2 and possibly additionally through the discharge opening arrangement 3. The liquid mixture components in the case of discontinous operation are supplied preferably only at the beginning of operation approximately simultaneously with or immediately following the introduction of the granular mixture components, namely through the two U-tubes 22 and 23. One particular advantage of the invention lies in that with one and the same installation it is possible to work either continuously or discontinuously. Continuous work takes place for example if mixture is conveyed away continuously, for example on heavy lorries with flying load-changing, concrete pumps etc. In this case a mixture of quantitatively more or less higher value can be ensured by appropriate adaptation of the continuous supply of mixture components and the continuous delivery of mixture to the size of the stationary batch constantly circulated in the mixing trough. Thus on the one hand it is possible to work with a great delivery if for example a lean concrete is required for road sub-structures, the quality of which is not subject to any particular requirements and on the other hand likewise in continuous operation it is possible to gain a mixture of very high grade quality, with correspondingly lower throughput.

The discontinuous manner of operation will be used as a rule for the production of mixture of maximum quality and on the other hand when the mixture is required by batches, namely each time in a large quantity per unit of time.

The problem observed frequently hitherto, that in the case of continuous mixers a relatively low grade mixture is produced at the beginning of operation before a stationary condition is reached, is readily avoidable in the case of use of the mixer according to the invention in that a more or less large starting phase is set in action during which no mixture is removed yet, so that the stationary condition corresponding to the desired homogeneity of the mixture is set before the beginning of the withdrawal of the mixture.

The transition between continuous and discontinuous operations can be carried out with only slight conversion measures. The construction expense for the double-shaft forced-feed mixer is relatively low, despite its suitability for both continuous and discontinuous operation, and not substantially higher than the construction expense for conventional monofunctional mixers for continuous or discontinuous operation.

What is claimed is:

1. Double-shaft forced-feed mixer for mixing powdered, granular and plastic materials, such as in the production of building material mixtures or the like, comprising a mixing trough (1) having an elongated direction with the trough having a top and a bottom extending in the elongated direction and a first end wall (12) and a second end wall (13) spaced apart in the elongated direction, two mutually parallel laterally spaced oppositely driven mixing shafts (4) located within said mixing trough (1) and extending in the elongated direction between said first and second end walls and forming a space therebetween, mixing tools (15) fitted on each of said mixing shafts in a spiral arrangement, each of said shaft (4) being rotatable about a horizontally arranged rotation axis, each said shaft (4) being rotatable in an opposite direction about the rotation axis thereof relative to the other said shaft so that in the space therebetween said mixing tools (15) move in the direction from the bottom toward the top of said trough (1), said mixing tools (15) on said mixing shafts (4) being arranged so that one of said shafts moves the mixture toward said first wall and the other said shaft moves the mixture toward said second wall, charging means (20, 22) for the introduction of at least granular mixture components downwardly into said trough (1) through the top thereof, a closable bottom emptying opening (2) located in the bottom of said trough (1) in the space between said mixing shafts (4) and extending over a major portion of the elongated direction between said first and second end walls, and means for selectively opening and closing said emptying opening (2), wherein the improvement comprises that said charging means (20, 22) of the granular mixture components are operable both for discontinuous and continuous addition of the granular mixture components, a discharge opening (3) located adjacent the transition of said first end wall and the bottom of said trough, said charging means (20, 22) comprises an entry (E) spaced in the elongated direction toward said second end wall from said discharge opening (3), means for opening and closing said discharge opening independently of said bottom emptying opening (2), whereby in continuous operation said bottom emptying opening (2) is closed and said discharge opening (3) is opened and a continuous branch flow passes through the discharge opening (3) corresponding to a continuous charging of the mixture components through said charging means (20, 22).

2. Double-shaft forced-feed mixer for mixing powdered, granular and plastic materials, such as in the production of building material mixtures or the like, comprising a mixing trough (1) having an elongated direction with the trough having a top and a bottom extending in the elongated direction and a first end wall (12) and a second end wall (13) spaced apart in the elongated direction, two mutually parallel laterally spaced oppositely driven mixing shafts (4) located within said mixing trough (1) and extending in the elongated direction between said first and second end walls and forming a space therebetween, mixing tools (15) fitted on each of said mixing shafts in a spiral arrangement, each said shaft (4) being rotatable about a horizontally arranged rotation axis, each said shaft (4) being rotatable in an opposite direction about the rotation axis thereof relative to the other said shaft so that in the space therebetween said mixing tools (15) move in the direction from the bottom toward the top of said trough (1), said mixing tools (15) on said mixing shafts (4) being arranged so that one of said shafts moves the mixture toward said first wall and the other said shaft moves the mixture toward said second wall, charging means (20, 22) for the introduction of at least granular mixture components downwardly into said trough (1) through the top thereof, a closable bottom emptying opening (2) located in the bottom of said trough (1) in the space between said mixing shafts (4) and extending over a major portion of the elongated direction between said first and second end walls, and means for selectively opening and closing said emptying opening (2), wherein the improvement comprises that said charging means (20, 22) includes an entry for continuous charging of granular mixture components downwardly into said mixing trough (1), a discharge opening (3) located adjacent the transition of said first end wall and said bottom, said discharge opening (3) being openable and closable independently of said bottom emptying opening (2), an entry (E) being located between said first and second end walls and being spaced from said discharge opening and located closer to said second-end wall, said shafts forming a circulation path (Z) having a first section extending from said first end wall toward said second end wall and a second section extending from said second end wall toward said first end wall, whereby with said bottom emptying opening (2) being closed and said discharge opening (3) being open, a continuous inflow of granular mixture components into said trough through said entry (E) and a continuous discharge of the mixture components is possible while a portion of the mixture circulating along the circulation path (Z) is maintained within the trough.

3. Double-shaft forced-feed mixer for mixing powdered, granular and plastic materials, such as in the production of building material mixtures or the like, comprising a mixing trough (1) having an elongated direction with the trough having a top and a bottom extending in the elongated direction and a first end wall (12) and a second end wall (13) spaced apart in the elongated direction, two mutually parallel laterally spaced oppositely driven mixing shafts (4) located within said mixing trough (1) and extending in the elongated direction between said first and second end walls and forming a space therebetween, mixing tools (15) fitted on each of said mixing shafts in a spiral arrangement, each said shaft (4) being rotatable about a horizontally arranged rotation axis, each said shaft (4) being rotatable in an opposite direction about the rotation axis thereof relative to the other said shaft so that in the space therebetween said mixing tools (15) move in the direction from the bottom toward the top of said trough (1), said mixing tools (15) on said mixing shafts (4) being arranged so that one of said shafts moves the mixture toward said first wall and the other said shaft moves the mixture toward said second wall, charging means (20, 22) for the introduction of at least granular mixture components downwardly into said trough (1) through the top thereof, a closable bottom emptying opening (2) located in the bottom of said trough (1) in the space between said mixing shafts (4) and extending over a major portion of the elongated direction between said first and second end walls, and means for selectively opening and closing said emptying opening (2), wherein the improvement comprises that said charging means (20, 22) includes an entry (E) for continuous charging of granular mixture components downwardly into said mixing trough (1), a discharge opening (3) located adjacent the transition of said first end wall and said bottom, said discharge opening (3) being openable and closable independently of said bottom emptying opening (2), said entry (E) being located between said first and second end walls and being spaced from said discharge opening and located closer to said second end wall, said shafts forming a circulation path (Z) having a first section extending from said first end wall toward said second end wall and a second section extending from said second end wall toward said first end wall, whereby with said bottom emptying opening (2) being closed and said discharge opening (3) being open, a continuous inflow of granular mixture components into said trough through said entry (E) and a continuous discharge of the mixture components is possible while a portion of the mixture circulates along the circulation path (C) is maintained within the trough, said entry (E) for the granular mixture components into said mixing trough (1) aligned above the upstream section of said circulation path (Z) for conveying the components in the direction from said first end wall toward second end wall, and said entry (E) being spaced from said second end wall by a dimension in the range of 30 to 70% of the dimension of the elongated direction between said first and second end walls.

4. A method of operating a double-shaft forced-feed mixer for continuous inflow of mixture components and continuous discharge of the mixed mixture components, comprising a mixing trough (1) having an elongated direction with the trough having a top and a bottom extending in the elongated direction and a first end wall (12) and a second end wall (13) spaced apart in the elongated direction, two mutually parallel laterally spaced oppositely driven mixing shafts (4) located within said mixing trough (1) and extending in the elongated direction between said first and second end walls and forming a space therebetween, mixing tools (15) fitted on each of said mixing shafts in a spiral arrangement, each said shaft (4) being rotatable about a horizontally arranged rotation axis, each said shaft (4) being rotatable in an opposite direction about the rotation axis thereof relative to the other said shaft so that in the space therebetween said mixing tools (15) move in the direction from the bottom toward the top of said trough (1), said mixing tools (15) on said mixing shafts (4) being arranged so that one of said shafts moves the mixture toward said first wall and the other said shaft moves the mixture toward said second wall, charging means (20, 22) for the introduction of at least granular mixture components downwardly into said trough (1) through the top thereof, a closable bottom emptying opening (2) located in the bottom of said trough (1) in the space between said mixing shafts (4) and extending over a major portion of the elongated direction between said first and second end walls, and means for selectively opening and closing said emptying opening (2), said charging means (20, 22) includes an entry for continuous charging of granular mixture components downwardly into said mixing trough (1), a discharge opening (3) located adjacent the transition of said first end wall and said bottom, said discharge opening (3) being openable and closable independently of said bottom emptying opening (2), said entry (E) being located between said first and second end walls and being spaced from said discharge opening and located closer to said second end wall, said shafts forming a circulation path (C) having a section extending from said first end wall toward said second end wall and a second section extending from said second end wall toward said first end wall, whereby with said bottom emptying opening (2) being closed and said discharge opening (3) being open, a continuous inflow of granular mixture components into said trough through said entry (E) and a continuous discharge of the mixture components is possible while a portion of the mixture circulates along the circulation path (C) is maintained within the trough, wherein the improvement comprises the steps of closing the bottom emptying opening, opening the discharge opening, introducing a continuous inflow of the mixture components through the entry (E), operating the mixing shafts for moving the mixture components first toward the second end wall, then toward the first end wall, and continuously moving a portion of the mixed mixture components moved toward the first wall from the discharge opening and circulating the remaining portion of the mixed mixture components toward the second end wall.

5. Double-shaft forced-feed mixer according to claim 1, wherein the entry (E) of the charging means (20) of the granular mixture components into the mixing trough (1) is aligned above the one of said mixing shafts (4) which conveys mixture components away from the first end wall (12) adjacent to the discharge opening arrangement (3).

6. Double-shaft forced-feed mixer according to claim 5, wherein the entry (E) of the charging means (20) of the granular mixture components lies at a distance from the second end wall (13) remote from the discharge opening (3), and the distance amounts to about 30 to 70% of the dimension of the elongated direction clear internal length of the mixing trough (1) between the first and second end walls.

7. Double-shaft forced-feed mixer according to claims 2, characterized in that the discharge opening arrangement (3) is larger in the direction transverse to the mixing shafts (4) than in the mixing shaft direction.

8. Double-shaft forced-feed mixer according to claim 7, wherein said trough comprises a double U-shaped bottom extending in the elongated direction, and the discharge opening (3) extends transversely of the elongated direction approximately between the lowest points the double U-shaped bottom.

9. Double-shaft forced-feed mixer according to claim 2, wherein the charging means (22, 23) for liquid mixture components are arranged approximately along the entire batch circulation path (z) within the mixing trough (1), and in that for continuous operation the liquid outflow from the charging means (22) can be limited to a part of the circumference of the batch circulation path (z) along one end wall (12, 13) and along the mixing shafts (4).

10. Double-shaft forced-feed. mixer according to claim 9, wherein the charging means (22, 23) for the liquid mixture components comprises two separately supplied U-tubes (22, 23) having a length with liquid delivery points distributed over the length, which are aligned in part over the mixing shafts (4), with a first U-tube (22), intended for continuous operation, extending—seen in plan view—approximately along the mixing shaft axes and along the second end wall, and a second U-tube (23) combining with the first U-tube (22) to form an approximately closed loop.

11. Double-shaft forced-feed mixer according to claim 5, wherein the charging means (20, 21) for the granular mixture component comprise a separate charging position (21) for batch charging aligned above the space between two mixing shafts (4) in the middle of the mixing trough between the first and second end walls (12, 13).

12. Double-shaft forced-feed mixer according to claim 1 wherein said mixing shafts (4) are each equipped, at an end (A) where the movements effected by them of the mixture batch strikes upon the first end wall (12), with a reversing device (17) which deflects the mixture along the respective end wall (12) from one to the other of said mixing shaft (14).

13. Double-shaft forced-feed mixer according to claim 2 wherein a baffle element (11) is arranged in the circulation path (Z) of the mixture batch adjacent to and upstream of the discharge opening (3).

14. Double-shaft forced-feed mixer according to claim 13, wherein the baffle element (11) is provided with apertures (18).

15. Double-shaft forced-feed mixer according to claim 1, wherein the discharge opening (3) is formed with a single flat slider closure (10).

16. Double-shaft forced-feed mixer according to claim 1 wherein one of a single and double hinged flap closure (10) and a segment closure is provided at the discharge opening (3).

17. Double-shaft forced-feed mixer according to claim 1 characterized in that a single or double hinged flap closure is allocated to the emptying opening (2).

18. Double-shaft forced-feed mixer according to claim 1 characterised in that a filling level regulation system is provided.

19. Double-shaft forced-feed mixer according to claim 18, wherein the filling level regulation system measures one of the batch size and the filling level by means of a batch size signaller, and corrects deviations from an ideal value by variation of at least one of mixture component charging and of the mixture outlet.

20. Double-shaft forced-feed mixer according to claim 9, wherein the part circumference extends from the entry (E) of said charging means (20) toward said second end wall then extends generally parallel to second end wall and then extends toward said first end wall to a position (L) spaced from the discharge opening.

21. Double-shaft forced-feed mixer according to claim 13, wherein said baffle element (11) is positioned in the circulation path (Z).

22. Double-shaft forced-feed mixer according to claim 13, wherein said baffle element (11) is adjustably positioned in the circulation path (Z).

23. Double-shaft forced-feed mixer according to claim 13, wherein said baffle element (11) is pivotally mounted.

24. Double-shaft forced-feed mixer according to claim 13, wherein said baffle element (11) is withdrawably positioned in the circulation path.

25. Double-shaft forced-feed mixer according to claim 14, wherein said apertures are of a variable number, shape and size.

26. Double-shaft forced-feed mixer according to claim 1, wherein the discharge opening (3) is formed with a double flat slided closure and said double flap slider closure comprises two flat sliders located close to one another and arranged vertically offset in relation to one another.

* * * * *